US007459994B2

(12) United States Patent
Chen et al.

(10) Patent No.: US 7,459,994 B2
(45) Date of Patent: Dec. 2, 2008

(54) HOUSING OF SATELLITE RECEIVER AND METHOD FOR FORMING THE SAME

(75) Inventors: Yung-Chin Chen, Taipei Hsien (TW); Hung-Yuan Lin, Taipei Hsien (TW); San-Yi Kuo, Taipei Hsien (TW)

(73) Assignee: Wistron NeWeb Corporation, Hsi-Chih, Taipei Hsien (TW)

( * ) Notice: Subject to any disclaimer, the term of this patent is extended or adjusted under 35 U.S.C. 154(b) by 443 days.

(21) Appl. No.: 11/307,473

(22) Filed: Feb. 9, 2006

(65) Prior Publication Data

US 2007/0139136 A1 Jun. 21, 2007

(30) Foreign Application Priority Data

Dec. 15, 2005 (TW) ..... 94144521 A

(51) Int. Cl.
*H01P 5/12* (2006.01)

(52) U.S. Cl. ..... 333/137; 333/248

(58) Field of Classification Search ..... 333/137, 333/135, 239–242, 248
See application file for complete search history.

(56) References Cited

U.S. PATENT DOCUMENTS 3,228,074 A * 1/1966 Rubel et al. ..... 164/14
6,388,633 B1 5/2002 Imaizumi
7,280,080 B2 * 10/2007 Baird et al. ..... 343/776
2006/0207742 A1 * 9/2006 Garza-Ondarza et al. ... 164/132

FOREIGN PATENT DOCUMENTS

CN 2362239 Y 2/2000

* cited by examiner

*Primary Examiner*—Benny Lee
*Assistant Examiner*—Kimberly E Glenn
(74) *Attorney, Agent, or Firm*—Winston Hsu

(57) ABSTRACT

Since gaps generated when assembling a high-frequency satellite receiver interrupt reception of satellite signals, accurate assembly or reduction in number of parts for assembly reduces interruption of reception of satellite signals. A signal feeding portion, a circuit board containing portion, and a signal output portion of a high-frequency satellite receiver extend from a first side of a main body of the high-frequency satellite receiver, so that the main body, the signal feeding portion, the circuit board containing portion, and the signal output portion are monolithically formed together, thereby preventing gaps resulting from assembly from affecting the reception of satellite signals.

19 Claims, 10 Drawing Sheets

HOUSING OF SATELLITE RECEIVER AND METHOD FOR FORMING THE SAME

BACKGROUND OF THE INVENTION

1. Field of the Invention

The present invention relates to a satellite receiver, and more particularly, to a satellite receiver that is monolithically formed.

2. Description of the Prior Art

A high-frequency satellite receiver is assembled from several elements due to the limitation of the shape of the high-frequency satellite receiver. The assembly generates gaps between each element, and such gaps not only interrupt reception of satellite signals, but also tend to let rain enter the high-frequency satellite receiver, resulting in damage and shortening of product lifespan.

Please refer to FIG. 1, which is an exploded diagram of a satellite receiver 1 according to the prior art. The satellite receiver 1 comprises a main body 10, three signal feeding portions 12, a circuit board containing portion 14, and a signal output portion 16, wherein the signal output portion 16 is fixed on the main body 10 via screws 11. Since the satellite receiver 1 is monolithically formed by the main body 10 and the signal feeding portions 12, the molds of the signal feeding portions 12 cannot be drawn (taken apart) in an X direction (upward and downward), but instead are drawn in a Y direction (frontward and rearward). This results in the signal output portion 16 not being formed along with the main body 10. If the signal output portion 16 were formed along the main body 10, drawing the mold of the signal output portion 16 would interfere with drawing the mold of the signal feeding portion 12. Therefore, the signal output portion 16 must be fixed on the main body 10 instead of being formed along with the main body 10. This increases process steps and time for making the assembly.

Please refer to FIG. 2, which is an exploded diagram of a satellite receiver 2 according to the prior art. The satellite receiver 2 comprises a main body 20, a signal feeding portion 22, a circuit board containing portion 24, and a signal output portion 26, wherein the signal feeding portion 22 is fixed on the main body 20 via screws 21. The satellite receiver 2 of FIG. 2 is not monolithically formed by the main body 20 and the signal feeding portion 22 due to the size and the shape of the circuit board containing portion 24. Since the projection of a tube 25 of the signal feeding portion 22 is not apart from the circuit board containing portion 24, if the signal feeding portion 22 were formed along with the main body 20, drawing the mold of the circuit board containing portion 24 would interfere with drawing the mold of the tube 25 of the signal feeding portion 22. Therefore, the signal feeding portion 22 is fixed on the main body 20 to prevent such interference. In addition, in order to prevent rain from entering the gaps, the prior art places an O-ring 23 between the signal feeding portion 22 and the main body 20 to seal the connection portion to be somewhat waterproof.

As mentioned above, due to the shape of the high-frequency satellite receiver and the interference when drawing the molds, the high-frequency satellite receiver must be assembled by several elements. However, the high-frequency satellite receiver is a high-precision product, and gaps resulting from the assembly and affecting the reception of satellite signals should be avoided. Additionally, rain might enter the high-frequency satellite receiver via gaps, resulting in a shortened product lifespan. Even though the prior art uses an O-ring for waterproofing, such an O-ring can become deformed after long use, causing it to no longer be waterproof.

SUMMARY OF THE INVENTION

The claimed invention discloses a housing of a satellite receiver. The housing comprises a main body, a signal feeding portion, a first circuit board containing portion, and a signal output portion. The signal feeding portion is extended from a first side of the main body, and comprises a plurality of signal receiving channels. The first circuit board containing portion is positioned on the first side of the main body for containing a first circuit board. The signal output portion is protruded from the main body, and comprises a plurality of signal output channels.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
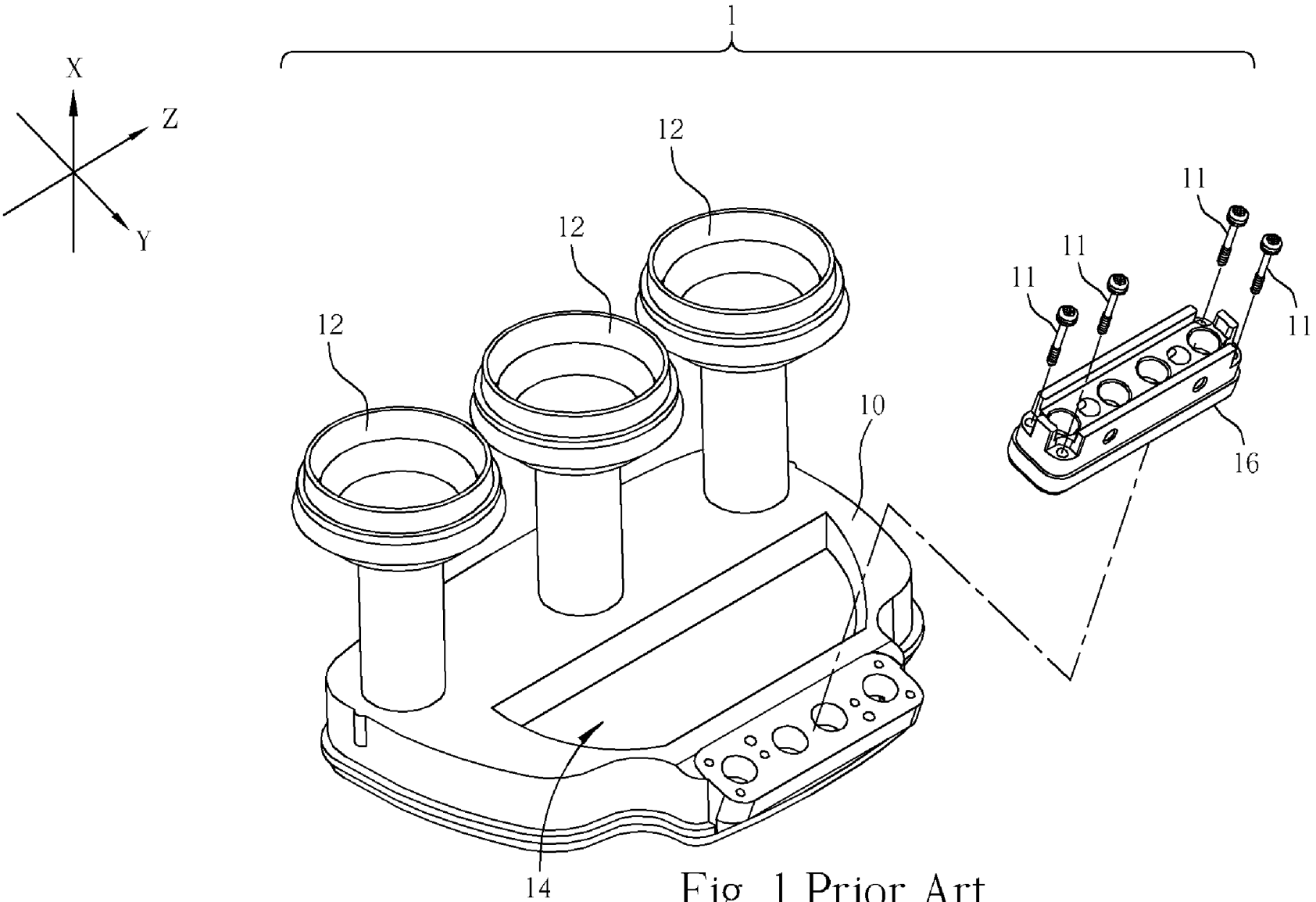
Fig. 1 Prior Art
FIG. 1 and FIG. 2 are exploded diagrams of different satellite receivers according to the prior art.
Figure 2:
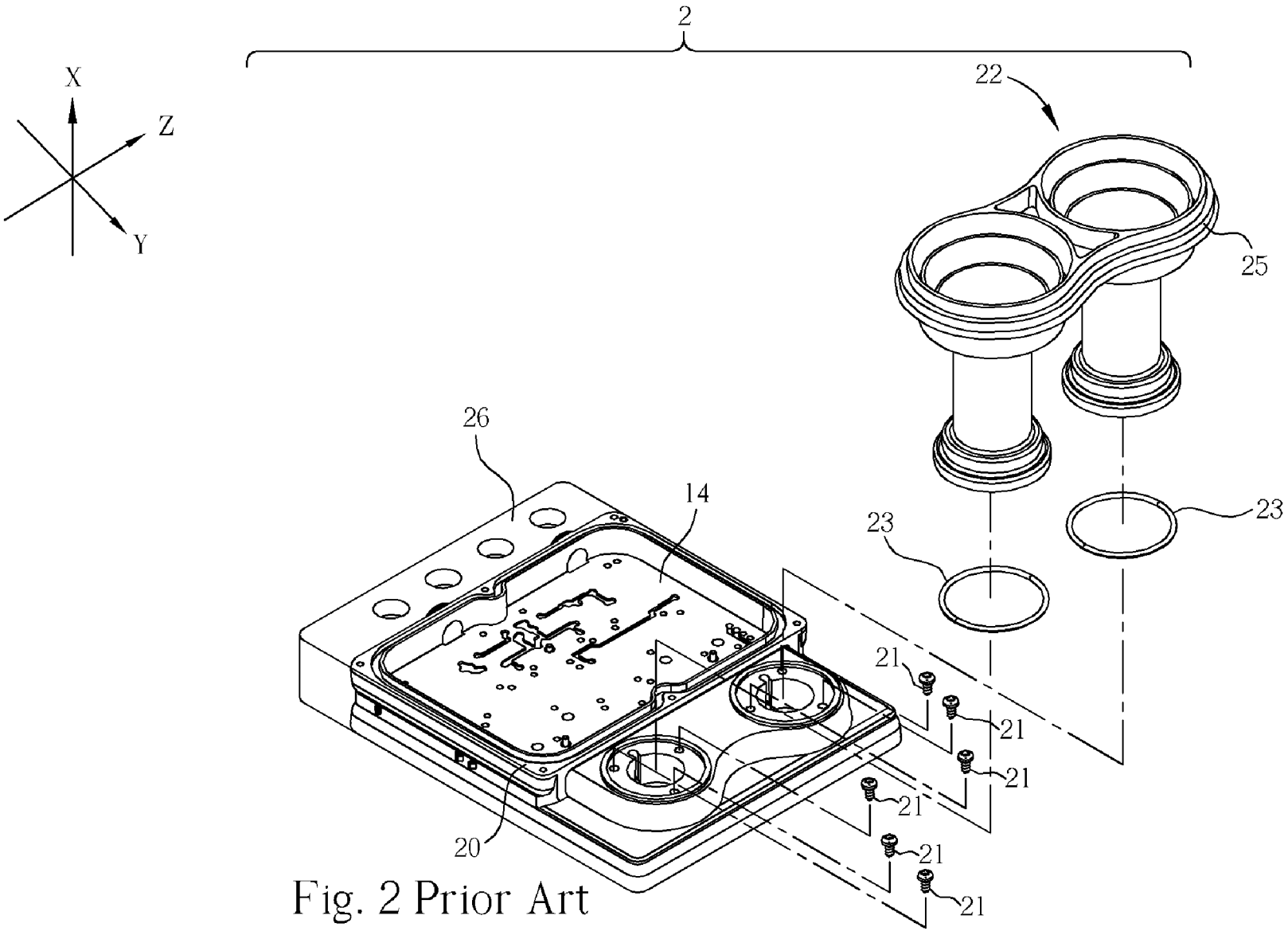
Fig. 2 Prior Art
Figure 3:
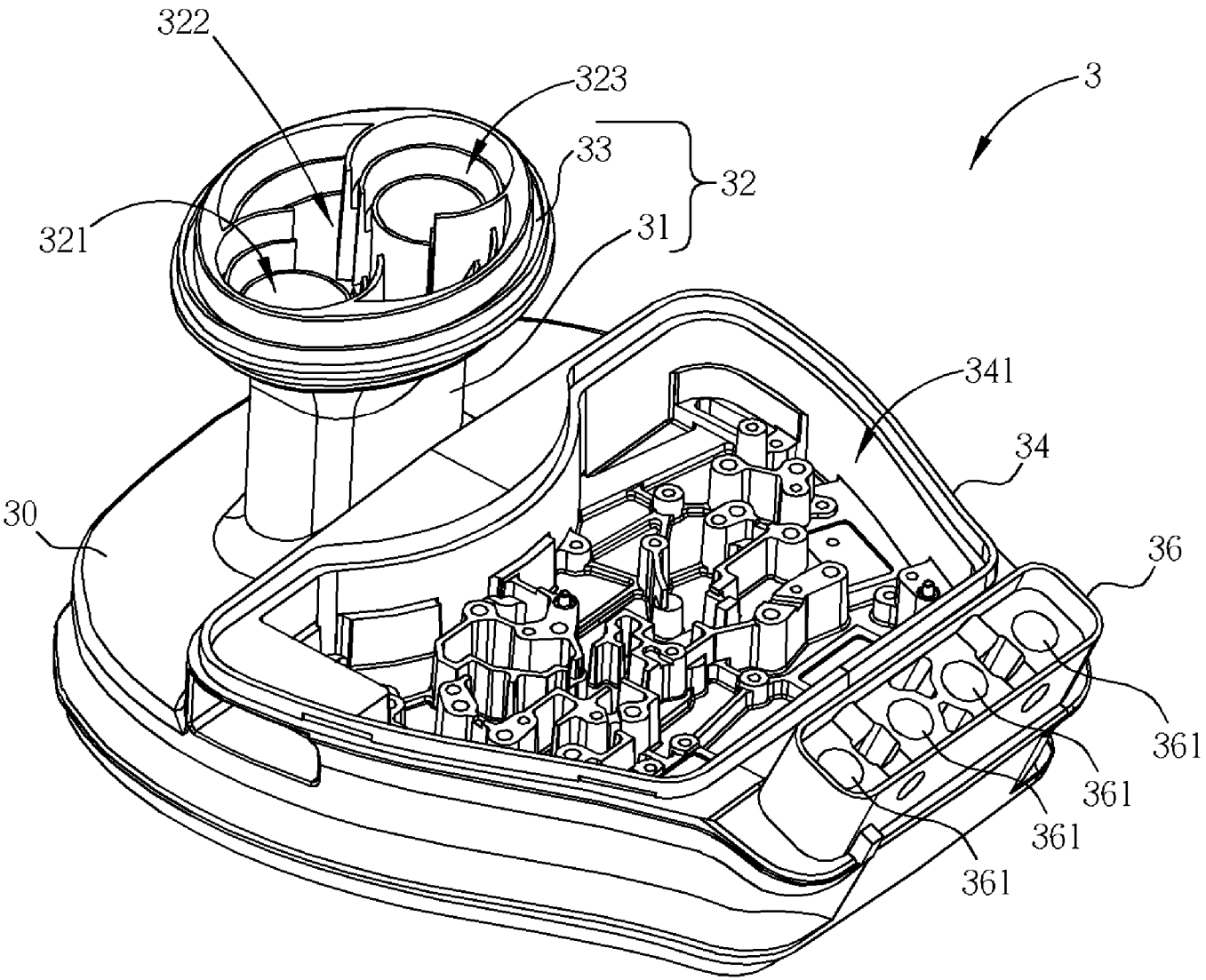
FIG. 3 is a diagram of a satellite receiver according to the present invention.

Please refer to FIG. 3, which is a diagram of a satellite receiver 3 according to the present invention. The satellite receiver 3 comprises a main body 30, a signal feeding portion 32, a first circuit board containing portion 34, and a signal output portion 36. The signal feeding portion 32 comprises a first tube 31, a second tube 33, and a plurality of signal receiving channels 321, 322, 323 for receiving satellite signals. The first circuit board containing portion 34 comprises a first recess 341 for containing a circuit board. The signal output portion 36 comprises a plurality of signal output channels 361. The satellite receiver 3 of the present invention is monolithically formed; no gaps exist on the satellite receiver 3. Therefore, the present invention can solve the problem of the reception of satellite signals affected by gaps and prevent the satellite receiver 3 from damage because of rain.

Figure 4:
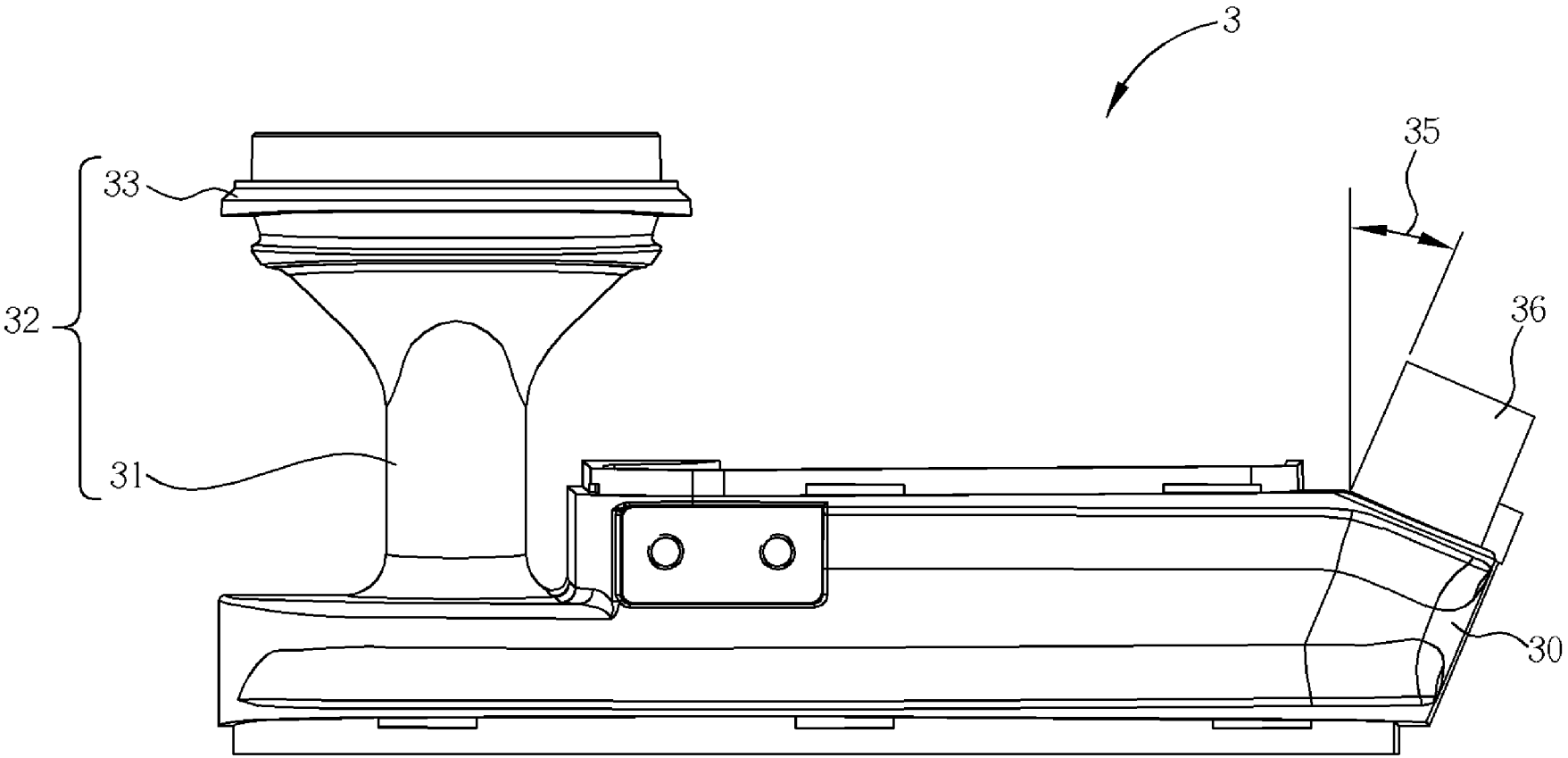
FIG. 4 to FIG. 6 are respectively a side view, a top view, and a bottom view of the satellite receiver of FIG. 3.
Figure 5:
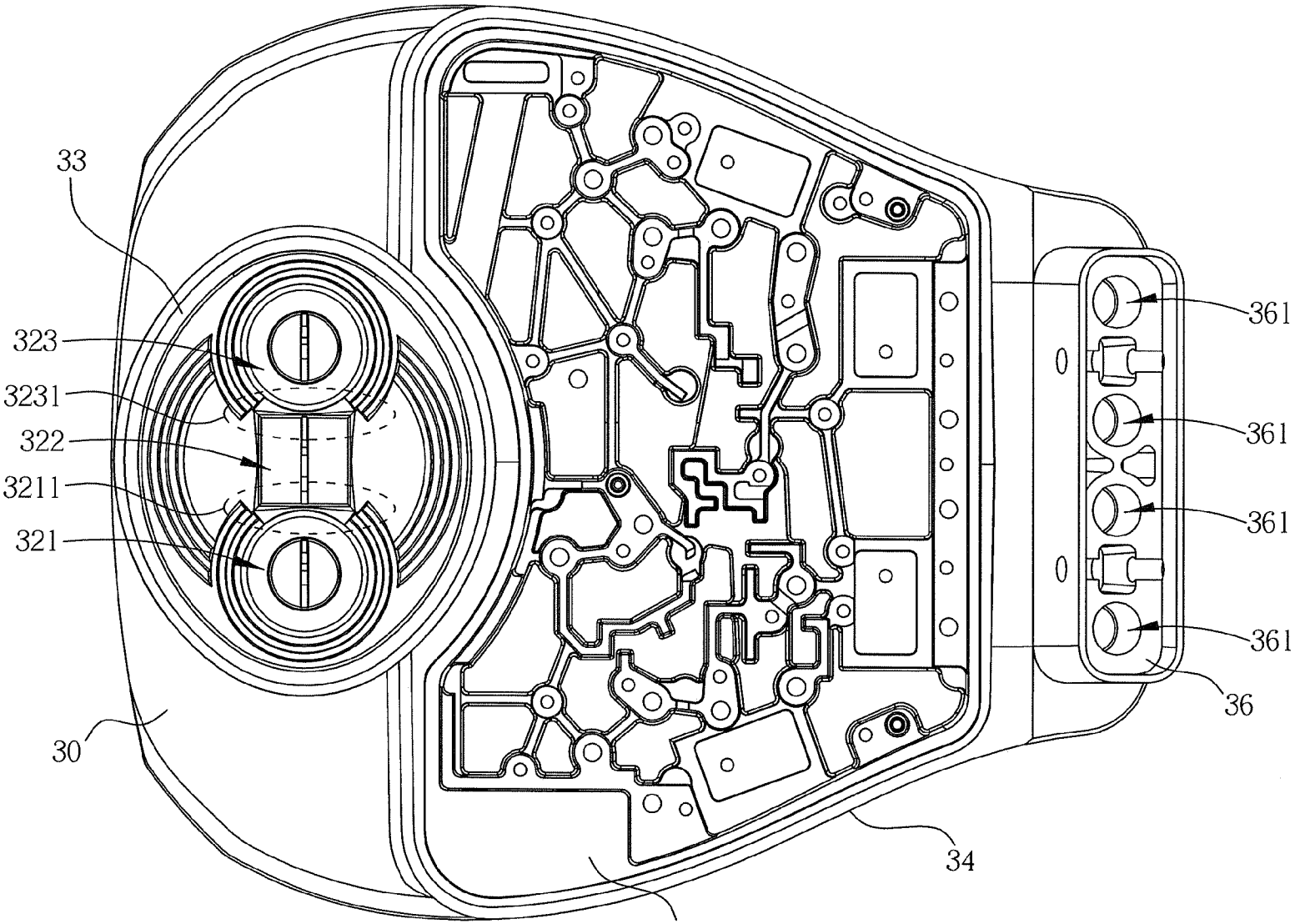
Figure 6:
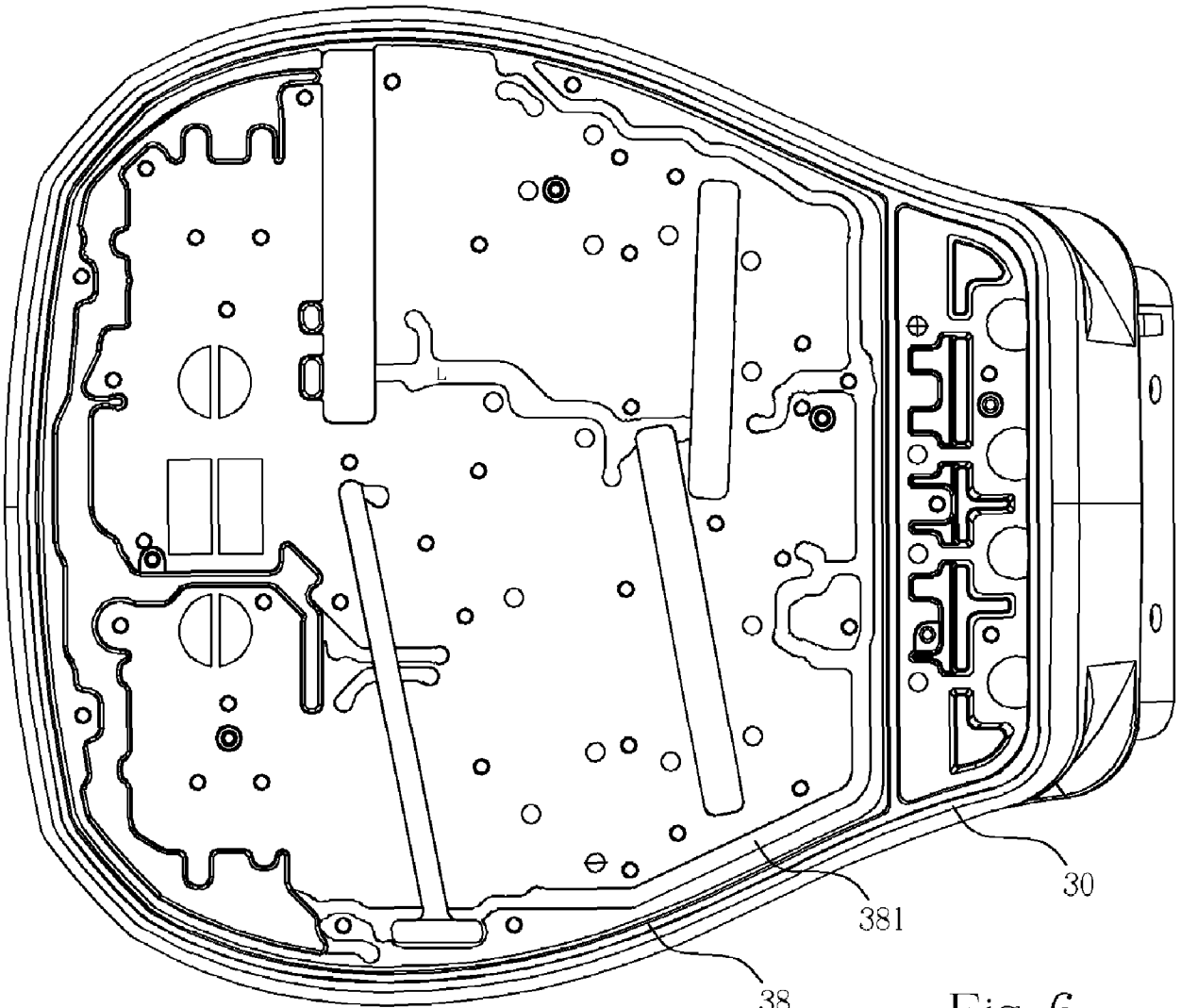

Please refer to FIG. 4 to FIG. 6, which are respectively a side view, a top view and a bottom view of the satellite receiver 3 of FIG. 3. In FIG. 4, the signal output portion 36 is protruded from the main body 30 at an angle 35. Since different countries have different specifications for shapes of high-frequency satellite receivers, the signal output portion 36 of the present invention can be positioned at any angle depending on the specification.

In FIG. 5, the shapes of the signal receiving channels 321, 322, 323 of the signal feeding portion 32 can be observed clearly. The signal receiving channels 321 and 323 are circular signal receiving channels having notches 3211 and 3231 respectively, and the signal receiving channel 322 is a rectangular signal receiving channel disposed between the notches 3211 and 3231 of the signal receiving channels 321 and 323. This can prevent interference between drawing out the mold (taking apart the mold) of the signal receiving channel 322 and drawing out the mold of the signal receiving channels 321, 323. Additionally, in order to prevent interference between drawing out the mold of the second tube 33 of the signal feeding portion 32 and drawing out the mold of the first circuit board containing portion 34, the present invention has a reduced-size or modified-shape first circuit board containing portion 34, so that the projection of the second tube 33 is apart from the first recess 341 of the first circuit board containing portion 34. The shapes of the signal receiving channels 321, 322, 323 of the signal feeding portion 32, the second tube 33, and the first circuit board containing portion 34 are not intended to be limited as shown in FIG. 5, but dependent on the shapes of installed antenna.

FIG. 6 is a bottom view of the satellite receiver 3. There is a second circuit board containing portion 38 positioned on the bottom of the satellite receiver 3. The second circuit board containing portion 38 comprises a second recess 381 for containing a circuit board.

Figure 7:
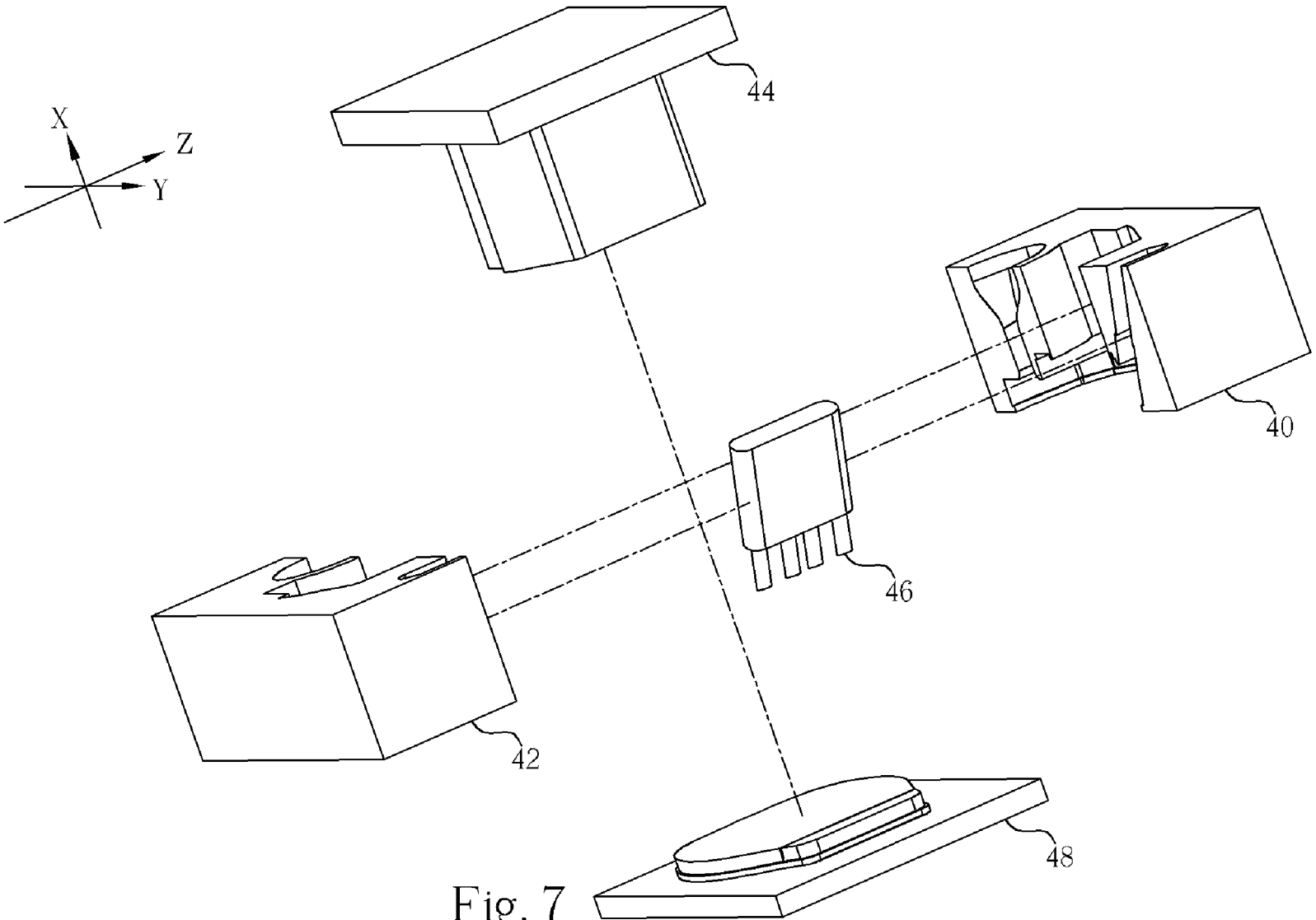
FIG. 7 and FIG. 8 are diagrams of molds for making the satellite receiver of FIG. 3.
Figure 8:
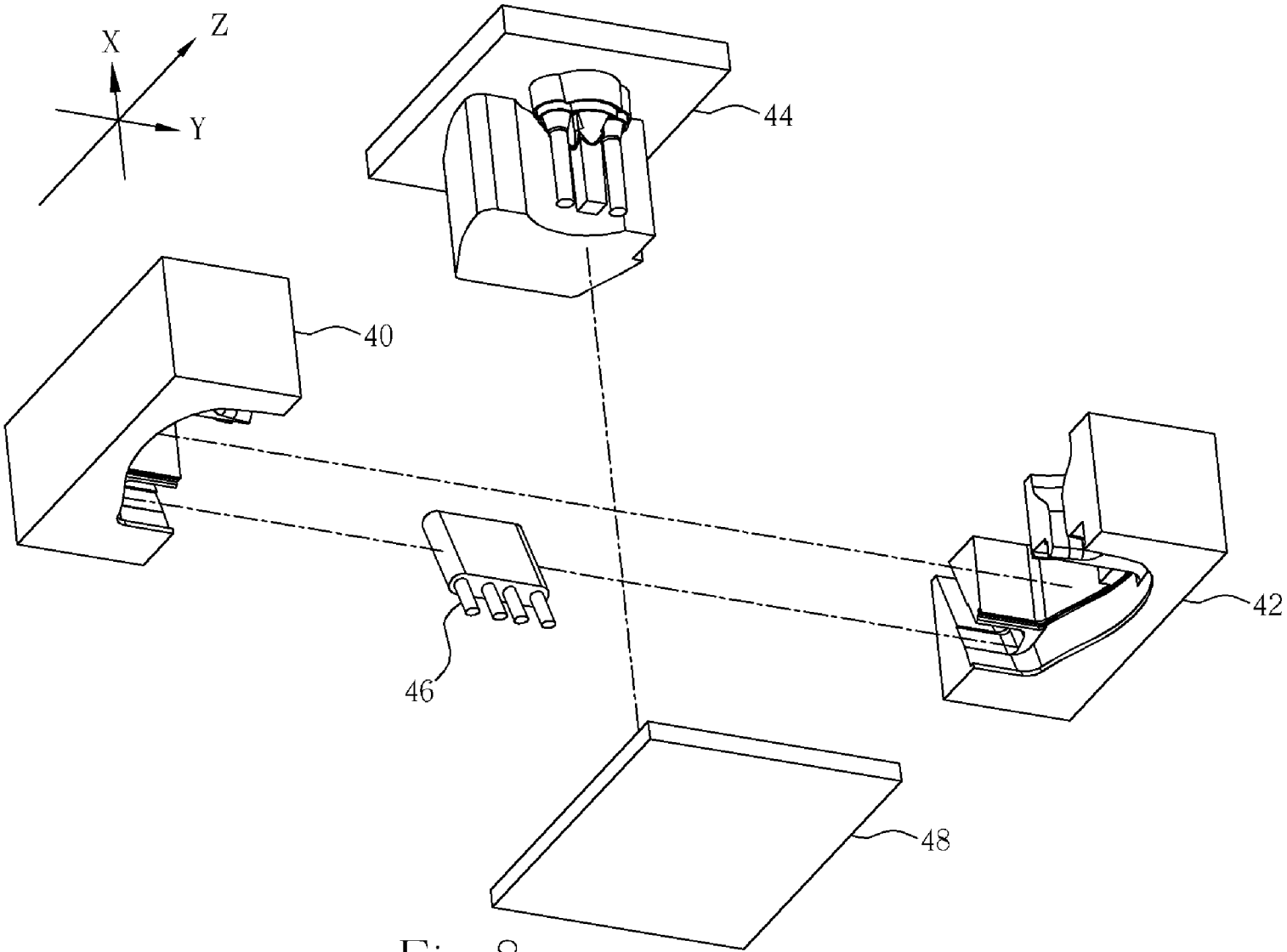
Figure 9:
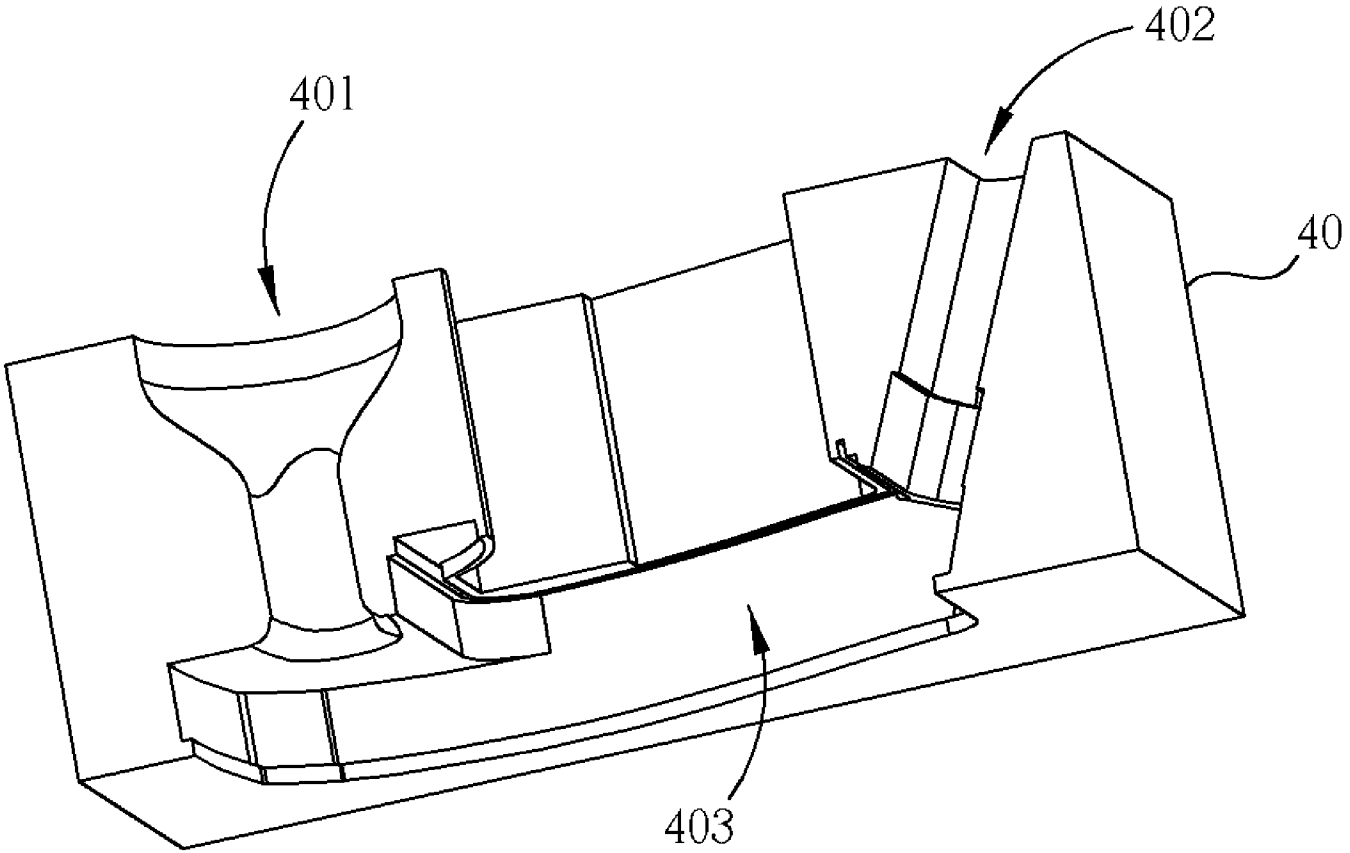
FIG. 9 and FIG. 10 respectively shows sub-molds of the first mold of FIG. 7.
Figure 10:
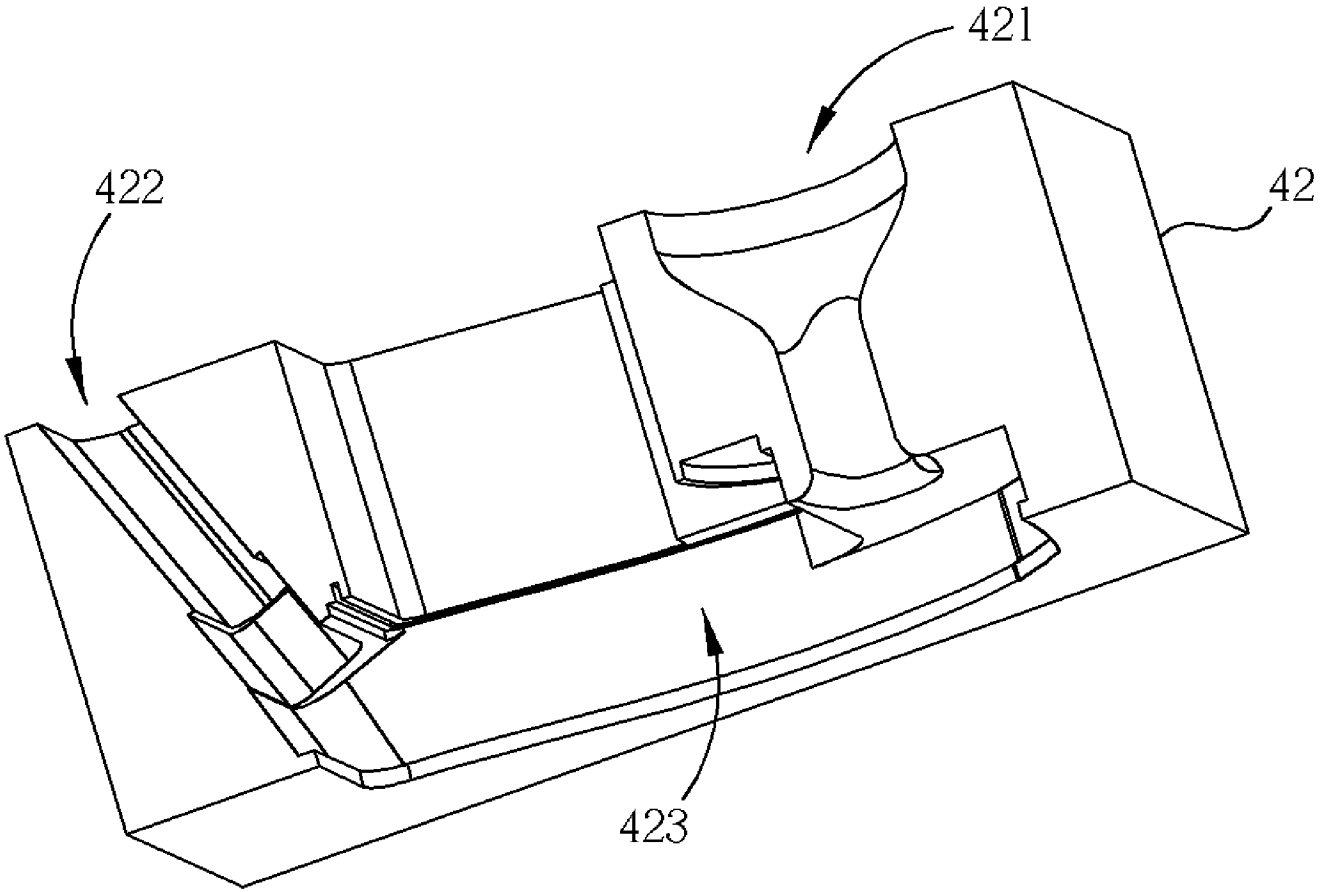

The above introduces the structure of the satellite receiver 3. The following introduces how to make the satellite receiver 3 of FIG. 3. Please refer to FIG. 7 and FIG. 8, which are diagrams of molds for making the satellite receiver 3. The first mold comprises a first sub-mold 40 and a second sub-mold 42. Please also refer to FIG. 9 and FIG. 10 showing the first sub-mold 40 and the second sub-mold 42, respectively. A sub-unit 401 of the first sub-mold 40 and a sub-unit 421 of the second sub-mold 42 are provided to form the housing of the signal feeding portion 32, including the first tube 31 and the second tube 33. A sub-unit 402 of the first sub-mold 40 and a sub-unit 422 of the second sub-mold 42 are provided to form the housing of the signal output portion 36. A sub-unit 403 of the first sub-mold 40 and a sub-unit 423 of the second sub-mold 42 are provided to form the main body 30, the housing of the first circuit board containing portion 34, and the housing of the second circuit board containing portion 38. A second mold 44 is provided to form the signal receiving channels 321, 322, 323 inside the housing of the signal feeding portion 32, and form the first recess 341 inside the housing of the first circuit board containing portion 34. A third mold 46 is provided to form the signal output channels 361 inside the housing of the signal output portion 36. A fourth mold 48 is provided to form the second recess 381 of the second circuit board containing portion 38 on the bottom of the main body 30.

The sequence of connecting all molds is as follows. The first sub-mold 40 is connected to the second sub-mold 42 in a Z direction. Then the second mold 44 and the fourth mold 48 are connected to the first sub-mold 40 and the second sub-mold 42 in the X direction. Finally, the third mold 46 is connected to the first sub-mold 40 and the second sub-mold 42 along the angle 35 (as shown in FIG. 4) corresponding to the X direction, thereby completing a module. Next, molding material, such as liquid aluminum, is injected into the module, and is heated and pressurized to form the satellite receiver 3. The sequence of drawing out all molds is opposite the sequence of connecting all molds. The third mold 46 is drawn out at an oblique angle. Then, the second mold 44 and the fourth mold 48 are drawn out in the X direction. Finally, the first sub-mold 40 and the second sub-mold 42 are drawn out in the Z direction.

The satellite receiver of the present invention is monolithically formed, and no assembly is required. Therefore, the present invention can solve the problems caused by gaps, and reduce the time for making the satellite receiver. Additionally, the present invention can prevent the satellite receiver from damage because of rain, thereby increasing the product lifespan.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A housing of a satellite receiver comprising:

a main body;

a signal feeding portion extended from a first side of the main body, the signal feeding portion comprising a plurality of signal receiving channels;

a first circuit board containing portion positioned on the first side of the main body for containing a first circuit board; and a signal output portion protruded from the main body, the signal output portion comprising a plurality of signal output channels;

wherein the plurality of signal receiving channels comprises two circular signal receiving channels respectively having a notch, and a rectangular signal receiving channel, the rectangular signal receiving channel being disposed between each of the notches of the circular signal receiving channels.

2. The housing of the satellite receiver of claim 1, wherein the first circuit board containing portion comprises a first recess for containing the first circuit board.

3. The housing of the satellite receiver of claim 2, wherein the signal feeding portion comprises a first tube connecting with a second tube, and a vertical projection area of the second tube on a plane of the main body is apart from the first recess of the first circuit board containing portion.

4. The housing of the satellite receiver of claim 1 further comprising a second circuit board containing portion formed on a second side of the main body.

5. The housing of the satellite receiver of claim 4, wherein the second circuit board containing portion comprises a second recess for containing a second circuit board.

6. The housing of the satellite receiver of claim 1, wherein the main body, the signal feeding portion, the first circuit board containing portion, and the signal output portion are monolithically formed together.

7. A method for forming the housing of the satellite receiver of claim 1, the method comprising:

connecting a first mold having a first sub-mold and a second sub-mold for forming the main body, a housing of the signal feeding portion, a housing of the first circuit board containing portion, and a housing of the signal output portion of the satellite receiver;

connecting a second mold to the first mold for forming the plurality of signal receiving channels inside the housing of the signal feeding portion, and forming a first recess inside the housing of the first circuit board containing portion;

connecting a third mold to the first mold for forming the plurality of signal output channels inside the housing of the signal output portion;

connecting a fourth mold to the first mold for forming a second recess inside a housing of a second circuit board containing portion on a second side of the main body;

injecting molding material into the molds for forming the housing of the satellite receiver;

drawing out the third mold after the housing of the satellite receiver is formed;

drawing out the second mold and the fourth mold simultaneously after the third mold is drawn; and drawing out the first sub-mold and the second sub-mold of the first mold after the second mold and the fourth mold are drawn.

8. The method of claim 7, wherein connecting the first mold further forms the second circuit board containing portion.

9. The method of claim 7, wherein connecting the first mold comprises connecting the first sub-mold and the second sub-mold of the first mold in a first direction, and connecting the second mold and the fourth mold to the first mold comprises connecting the second mold and the fourth mold to the first mold in a second direction perpendicular to the first direction.

10. The method of claim 9, wherein connecting the third mold to the first mold comprises connecting the third mold to the first mold in an acute angle direction corresponding to the second direction.

11. The method of claim 10, wherein drawing out the third mold comprises drawing out the third mold in the acute angle direction corresponding to the second direction.

12. The method of claim 11, wherein drawing out the second mold and the fourth mold simultaneously comprises drawing out the second mold and the fourth mold simultaneously in the second direction.

13. The method of claim 12, wherein drawing out the first sub-mold and the second sub-mold of the first mold comprises drawing out the first sub-mold and the second sub-mold of the first mold in the first direction.

14. The method of claim 7, wherein injecting molding material into the molds comprises injecting liquid aluminum into the molds.

15. A method of forming a housing of a satellite receiver, the method comprising:

providing a first mold for forming a main body, a housing of a signal feeding portion, a housing of a first circuit board containing portion, a housing of a signal output portion, and a housing of a second circuit board containing portion;

providing a second mold for forming a plurality of signal receiving channels inside the housing of the signal feeding portion and forming a first recess inside the housing of the first circuit board containing portion;

providing a third mold for forming a plurality of signal output channels inside the housing of the signal output portion;

providing a fourth mold for forming a second recess inside the housing of the second circuit board containing portion on a downside of the main body;

connecting the first mold, the second mold, the third mold and the fourth mold for forming a module; and injecting molding material into the module for forming the satellite receiver.

16. The method of claim 15, wherein providing the first mold comprises providing a first sub-mold and a second sub-mold.

17. The method of claim 16, wherein connecting the first mold, the second mold, the third mold and the fourth mold comprises connecting the first sub-mold and the second sub-mold in a first direction, and connecting the second mold and the fourth mold in a second direction perpendicular to the first direction.

18. The method of claim 17, wherein connecting the first mold, the second mold, the third mold and the fourth mold comprises connecting the third mold to the first mold in an acute angle direction corresponding to the second direction.

19. The method of claim 15, wherein injecting molding material into the molds comprises injecting liquid aluminum into the module.

* * * * *